United States Patent [19]

Rosenblum

[11] 4,133,546

[45] Jan. 9, 1979

[54] VEHICLE

[76] Inventor: Frank Rosenblum, 2370 Gold Ave., Apt. 202, St. Laurent, Quebec, Canada, H3A 1K4

[21] Appl. No.: 782,091

[22] Filed: Mar. 28, 1977

[51] Int. Cl.[2] ..... A63C 17/02

[52] U.S. Cl. ..... 280/11.1 BT; 280/87.04 A

[58] Field of Search ..... 280/87.04 A, 87.04 R, 280/1.11 R, 1.11 BT, 47.11

[56] References Cited

U.S. PATENT DOCUMENTS

| | | | |
|---|---|---|---|
| 3,436,088 | 4/1969 | Kunselman | 280/87.04 A |
| 3,856,321 | 12/1974 | Solymosi | 280/87.04 A |

FOREIGN PATENT DOCUMENTS

| | | | |
|---|---|---|---|
| 959743 | 10/1949 | France | 280/11.1 R |
| 264632 | 1/1950 | Switzerland | 280/87.04 A |
| 446984 | 3/1968 | Switzerland | 280/87.04 A |

*Primary Examiner*—John A. Pekar

*Attorney, Agent, or Firm*—Swabey, Mitchell, Houle, Marcoux & Sher

[57] ABSTRACT

The present invention relates to a coasting vehicle which is adapted to be steered. The vehicle includes a pair of parallel platforms adapted to rotate or tilt about parallel axes, the platforms being coupled together such that the planes of the platforms remain parallel to each other through said longitudinal axes throughout any pivoted position of the platform. Wheels are mounted outboard of the platform, fore and aft thereof, and are adapted to be steered by the pivoting movement of the platform.

8 Claims, 8 Drawing Figures

VEHICLE

BACKGROUND OF THE INVENTION

1. Field of the Invention

The present invention relates to a wheeled vehicle, and more particularly, to a recreational-type, free wheeling vehicle for use in downhill coasting.

2. Description of the Prior Art

There have been many developments in free-wheeling coaster vehicles using a single or double platform, such as described in U.S. Pat. No. 3,992,025, issued Nov. 16, 1976, Amelio, inventor, and U.S. Pat. No. 3,436,088, issued Apr. 1, 1969, Kunselman, inventor. The former vehicle is typical of the well-known skateboards which include a single platform mounted on two pairs of roller skate type rollers and arranged to be steered by the shifting of one's weight on the platform. The latter patent describes a pair of parallel platforms linked together and mounted on roller skate type rollers whereby the steering of the vehicle can be made through a shifting of one's feet in the plane of the platforms.

SUMMARY OF THE INVENTION

It is an aim of the present invention to provide a vehicle of the type having two platforms coupled together for movement coasting down an inclined surface in a manner simulating skiing.

It is a further aim of the present invention to provide a vehicle on which a pair of platforms are coupled together and are adapted to receive each foot of a person such that the person, when applying a movement similar to the movement required in turning on skis (as in a carved turn), will cause the vehicle to steer in a direction in response to the movement of the person whose feet are secured to the platform.

In a construction in accordance with the present invention, there is provided a wheeled vehicle comprising a pair of elongated platforms with each platform being mounted for pivoting movement about each of a pair of parallel longitudinal axes, the platforms being coupled together such that the planes of the platforms remain parallel to each other through said longitudinal axes throughout any pivoted position of the platforms, wheels mounted fore and aft of the platforms and outboard of the platforms, at least one of such wheels being capable of being steered in reponse to rotation of the platforms.

Thus, by having the wheels outboard of the coupled platforms, they can be made larger so that the vehicle can be used on other than paved surfaces, and the platforms can be in planes which are below the rolling axis of the wheels, thereby improving the stability of the vehicle.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
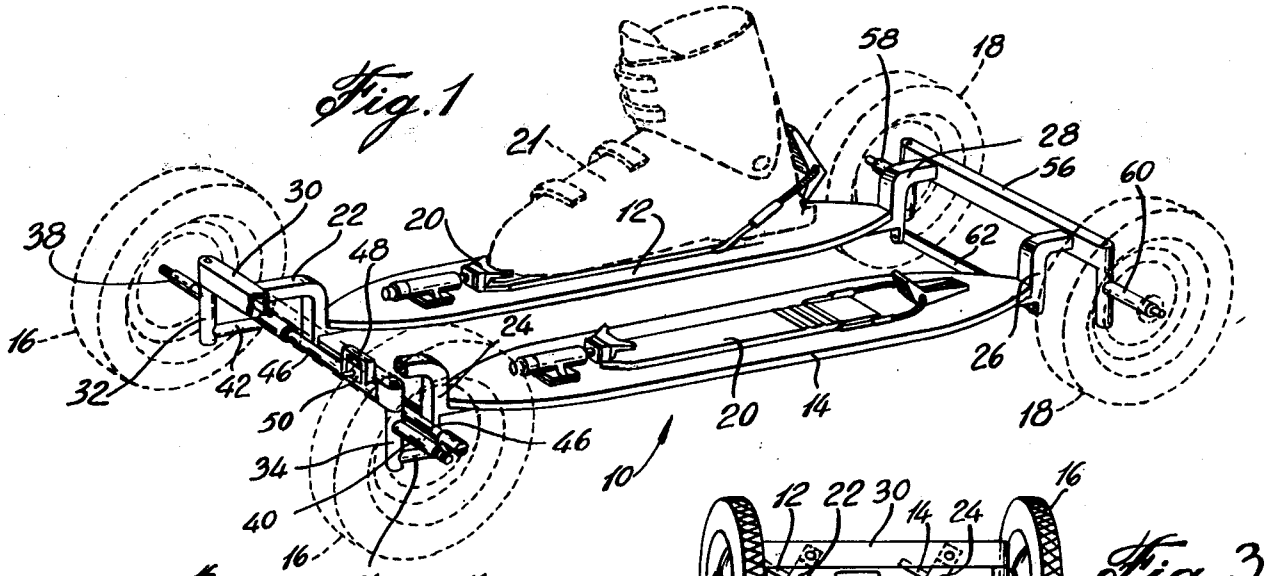
FIG. 1 is a perspective view of a vehicle according to the present invention.

Referring now to the drawings, the embodiment shown in FIGS. 1 to 6 includes a vehicle 10 having separate elongated platforms 12 and 14 mounted on a pair of front wheels 16 and a pair of rear wheels 18. Each platform 12 and 14 includes a conventional ski binding 20 adapted to receive respectively a person wearing ski boots 21. As on snow skis, the binding 20 would be of a releasable type so that the ski boots 21 would be released when an unusual torsional force is applied to the ski boots 21. The platforms 12 and 14 are fixed at each end to brackets. Platform 12 has a front bracket 22 and a rear bracket 28 while the platform 14 includes a front bracket 24 and a rear bracket 26. The front brackets 22 and 24 are pivotally connected to an axle 30 extending laterally thereof. Rear brackets 26 and 28 are in turn pivotally connected to axle 56 between the wheels 18.

Axle 30 at the front of the vehicle mounts a pair of king pins 32 and 34 at each end thereof for rotational movement perpendicular to the axle 30. A pair of stub axles 38 and 40 are respectively fixedly mounted to the king pins 32 and 34. The king pin 32 mounts a track arm 42 while the king pin 34 mounts a track arm 44 which in turn are connected by means of track rod 46. A bearing box 48 is fixedly mounted to the track rod 46 and a sliding block 50 is adapted to slide along a vertical axis within the bearing block 48. Coupling means in the form of a connecting bar 54 extends between the bottom portions of the brackets 22 and 24 and mounts a pin 52 which in turn is journaled in the sliding block 50.

The axle 56 includes stub axles 58 and 60 which mount wheels 18. The stub axles 58 and 60 are affixed to the axle so that there is no pivoting movement of the wheels relative to the axle. Another coupling means in the form of a connecting bar 62 is connected at each end to the brackets 28 and 26 so as to provide a parallelogram linkage between the brackets 28 and 26 as the connecting bar 54 provides a parallelogram linkage between the brackets 22 and 24. A single rear or front wheel could be provided instead of two wheels so as to form a three wheel vehicle. In such a case, a yoke bracket mounting the two platforms would be required.

The rear wheels could also be steered in a similar manner to the front wheels, but it would be preferable to have the turning ratio of the rear wheels relative to the front wheels in the area of 1 to 3, and in any case, less than the front wheels.

Figure 3:
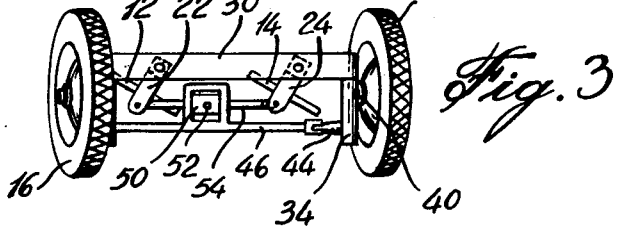
FIG. 3 is a front elevation of the vehicle with certain details of the vehicle in a different position.
Figure 2:
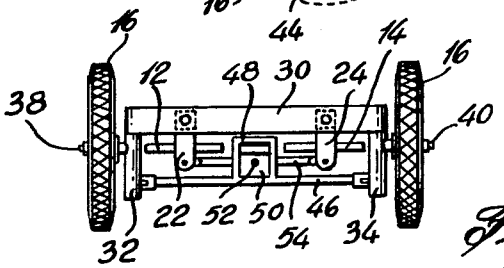
FIG. 2 is a front elevation of the vehicle.
Figure 4:
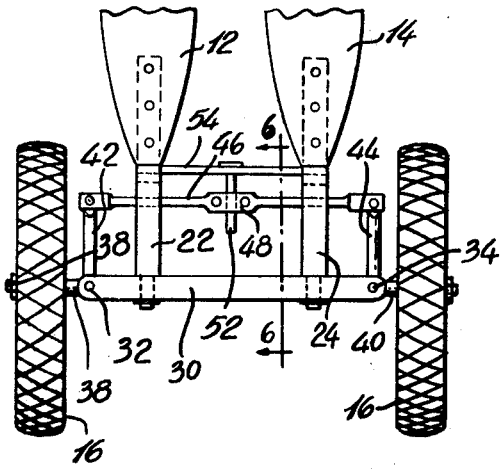
FIG. 4 is a fragmentary top plan view of a detail of the vehicle.
Figure 5:
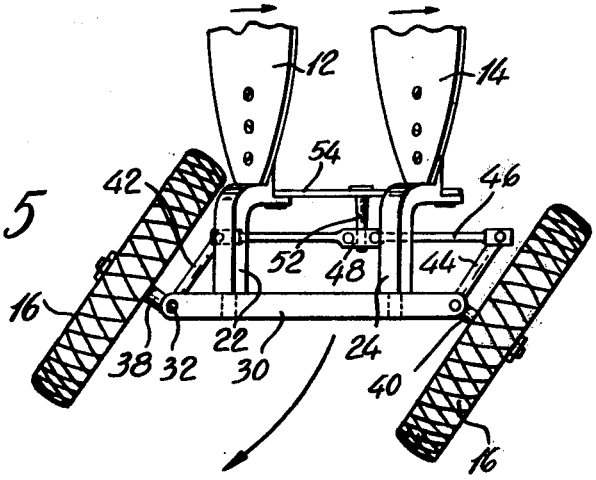
FIG. 5 is a fragmentary top plan view similar to FIG. 4 showing the detail in a different position.
Figure 6:
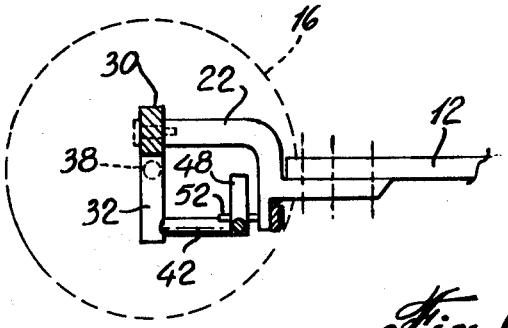
FIG. 6 is a fragmentary side elevation of the details shown in FIGS. 4 and 5.

In operation, a person puts on the ski boots 21 and engages the ski boots 21 in the bindings 20 on the platforms 12 and 14 and allows himself to coast down an inclined slope. The vehicle 10 can be steered by providing the same body movement which would be required for steering or turning a pair of skis in a similar manner to a racing type turn known as carving. For instance, if it is required to turn to the left, the person rolls his knees towards the left causing the platform to tilt or rotate about the longitudinal axis. The steering assembly, including the connecting bar 54 mounting the pin 52, will cause the track rod 46 to pivot the king pins 32 and 34, thereby steering the wheels 16 in a direction towards the left as shown in FIG. 3. If one wishes to steer the vehicle towards the right as shown in FIG. 5, the opposite movements are required.

Figure 7:
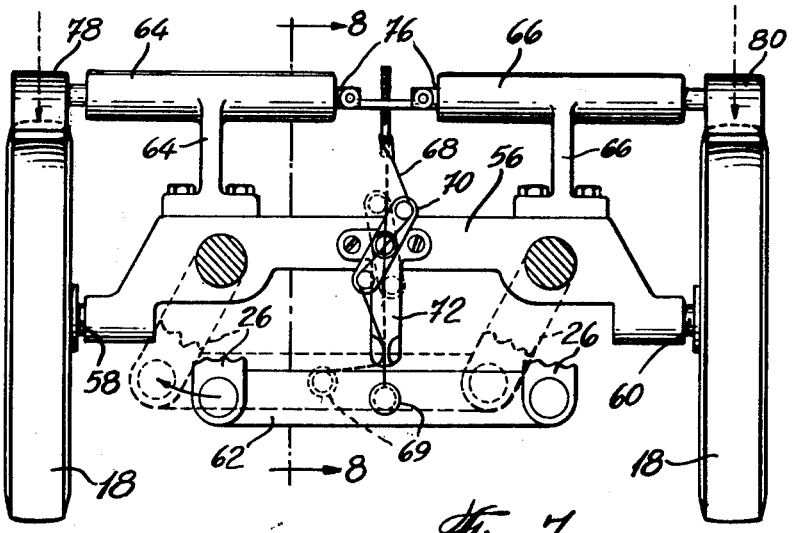
FIG. 7 is a vertical cross-section showing in elevation details of a further embodiment of the vehicle.
Figure 8:
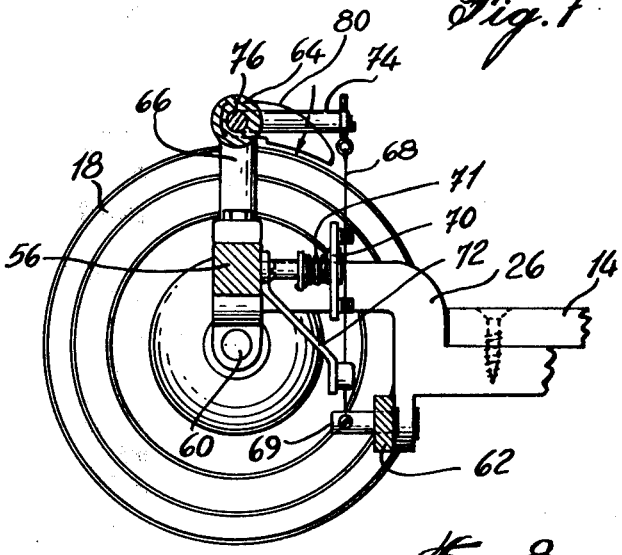
FIG. 8 is a vertical cross-section taken along line 8—8 of FIG. 7.

FIGS. 7 and 8 represent a further embodiment of the present invention wherein a braking system is provided in association with the rear axle 56 and the rear wheels 18. In this case, an anchor pin 69 would be provided on the connecting bar 62. A pair of brackets 64 and 66 would be mounted on the axle 56, and a rod 76 could be journaled in the brackets 64 and 66 as shown in FIGS. 7 and 8. The rod 76 would mount brake shoes 78 and 80 at each end thereof adapted to engage the wheels 18 on the outside periphery thereof. Rod 76 also includes pull arm 74 to which is connected a pull wire 68, the other end of which is connected to the anchor member 69. A tension device, including a pivoting tension member 70, which is actuated in a clockwise direction by a spring 71, engages the pull wire 68. A guide bracket 72 is provided below the tensioning member 70 in order to guide the pull wire 68. As the platforms 12 and 14 are tilted, the brackets 28 and 26 will cause the connecting bar 62 to move towards the left or to the right. Normal tilting of the platform will merely cause the connecting bar 62 to pull the pull wire 68 against the tensioning device 70. However, an extreme tilting of the platforms 12 and 14 will cause the pull wire 68 to pull on the pull arm 74, thus engaging the brake shoes 78 and 80 with the wheels 18.

In other embodiments (not shown), the longitudinal pivoting platforms could be coupled to each other and to the wheels by means of gears, chains or by means of a hydraulic system.

I claim:

1. A wheeled vehicle comprising a pair of elongated platforms with each platform being mounted to a fore and aft axle for pivoting movement about each of a pair of parallel longitudinal axes, means for coupling the platforms to each other such that the planes of the platforms remain parallel to each other through said longitudinal axes throughout any pivoted position of the platforms; wheels mounted on said axles outboard of the platforms; fore and aft thereof, steering means engaged by said coupling means, a pair of said wheels mounted for pivoting movement about respective vertical axes to the ends of at least one of the axles, said steering means including means for controlling the pivoting movement of the wheels pivoted to said axle.

2. A vehicle as defined in claim 1, wherein the planes of the platforms are spaced below the said parallel longitudinal axes.

3. An apparatus as defined in claim 1, wherein there are a pair of said wheels mounted to the ends of the fore axle and a pair of said wheels mounted to the ends of the aft axle, and wherein said steering means includes a king pin member in each respective vertical axis at the ends of said fore axle connecting each fore wheel, said steering means also including tracking means connected between said coupling means and said king pins for controlling the steering of said wheels in response to the pivoting of the platforms.

4. Apparatus as defined in claim 3, wherein each platform is pivotally connected to a fore and aft axle by means of individual brackets fixed to the platform and pivotally connected about parallel horizontal axes to the respective axles and wherein said coupling means includes connecting bars provided between the pairs of brackets so as to provide the coupled parallel movement of the platform, and wherein said tracking means is connected between said connecting bar and the king pins of each front wheel so as to control the steering of the wheels with the pivoting movement of the platform.

5. An apparatus as defined in claim 4, wherein releasable ski bindings are provided on the platforms for receiving mating ski boots, one on each platform.

6. An apparatus as defined in claim 1, wherein at least one of the fore and aft axles includes a braking mechanism with a lost motion action between the coupling means for the platforms and the wheels mounted on the axle.

7. An apparatus as defined in claim 6, wherein said braking mechanism includes a pair of brackets mounted on the aft axle, a rod journaled in said brackets, brake shoes secured to said rod and adapted to engage the aft wheels, and a pull wire interconnecting said rod and said coupling means for rotating said rod to cause said brake shoes to engage the wheels upon tilting of the platforms.

8. An apparatus as defined in claim 7, further comprising a tensioning device engaging said pull wire, said tensioning device providing said lost motion action so as to permit actuation of the braking mechanism upon extreme tilting of the platforms.

* * * * *